US008797129B2

(12) United States Patent
Naka et al.

(10) Patent No.: US 8,797,129 B2
(45) Date of Patent: Aug. 5, 2014

(54) ELECTROMAGNETIC CONTACTOR

(75) Inventors: Yasuhiro Naka, Kounosu (JP); Kouetsu Takaya, Kounosu (JP); Kenji Suzuki, Kounosu (JP); Hiroyuki Tachikawa, Yokohama (JP)

(73) Assignees: Fuji Electric Co., Ltd., Kawasaki-shi (JP); Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/981,023

(22) PCT Filed: Apr. 3, 2012

(86) PCT No.: PCT/JP2012/002328

§ 371 (c)(1),
(2), (4) Date: Aug. 6, 2013

(87) PCT Pub. No.: WO2012/157171

PCT Pub. Date: Nov. 22, 2012

(65) Prior Publication Data

US 2013/0328647 A1 Dec. 12, 2013

(30) Foreign Application Priority Data

May 19, 2011 (JP) ..... 2011-112908

(51) Int. Cl.

| | |
|---|---|
| ***H01H 67/02*** | (2006.01) |
| ***H01H 3/00*** | (2006.01) |
| ***H01H 51/22*** | (2006.01) |
| ***H01H 50/36*** | (2006.01) |
| ***H01H 50/58*** | (2006.01) |
| *H01H 1/20* | (2006.01) |

(52) U.S. Cl.

CPC ..... *H01H 50/58* (2013.01); *H01H 51/2209* (2013.01); *H01H 50/36* (2013.01); *H01H 1/20* (2013.01)

USPC ..... 335/126; 335/189; 335/131

(58) Field of Classification Search

USPC ..... 335/78–86, 126, 131, 177, 179, 180, 335/189, 201, 202, 251, 255

See application file for complete search history.

(56) References Cited

U.S. PATENT DOCUMENTS 5,892,194 A * 4/1999 Uotome et al. ..... 218/68
7,852,178 B2 * 12/2010 Bush et al. ..... 335/126

(Continued)

FOREIGN PATENT DOCUMENTS

| | | |
|---|---|---|
| JP | S64-082607 A | 3/1989 |
| JP | H01-268005 A | 10/1989 |
| JP | H10-125196 A | 5/1998 |
| JP | 3107288 B2 | 9/2000 |

*Primary Examiner* — Bernard Rojas
(74) *Attorney, Agent, or Firm* — Manabu Kanesaka

(57) ABSTRACT

An electromagnetic contactor has a pair of fixed contacts; a movable contact disposed to be capable of contacting with and separating from the pair of fixed contacts; and an electromagnetic unit driving the movable contact. The electromagnetic unit has a magnetic yoke having an open upper part; an upper magnetic yoke cross-linked in the open upper part of the magnetic yoke; a spool having a central opening in which an exciting coil is wound around the spool; a movable plunger movably disposed in the central opening of the spool in an axial direction and having a tip end protruding, the movable plunger urged by a return spring; and an auxiliary yoke forming a magnetic path between the movable plunger and the U-shaped magnetic yoke when the movable plunger is in an open position. The movable plunger is coupled to the movable contact through a coupling shaft.

6 Claims, 14 Drawing Sheets

(56) References Cited

U.S. PATENT DOCUMENTS 7,911,301 B2 * 3/2011 Yano et al. ..... 335/131
8,179,217 B2 * 5/2012 Kawaguchi et al. ..... 335/80
8,446,239 B2 * 5/2013 Niimi et al. ..... 335/126
2006/0109070 A1 * 5/2006 Hirabayashi et al. ..... 335/126
2008/0246569 A1 * 10/2008 Bogdon et al. ..... 335/256
2013/0229248 A1 * 9/2013 Yokoyama et al. ..... 335/201
2013/0301181 A1 * 11/2013 Naka et al. ..... 361/194

* cited by examiner

ELECTROMAGNETIC CONTACTOR

RELATED APPLICATIONS

The present application is National Phase of International Application No. PCT/JP2012/002328 filed Apr. 3, 2012, and claims priority from Japanese Applications No. 2011-112908 filed May 19, 2011.

TECHNICAL FIELD

The present invention relates to an electromagnetic contactor having a fixed contact, a movable contact capable of contacting with and separating from the fixed contact, and an electromagnetic unit that drives the movable contact.

BACKGROUND ART

An electromagnetic contactor for opening/closing a current path is designed such that a movable contact thereof is driven by an exciting coil and movable plunger of an electromagnetic unit. In other words, while the exciting coil is in a non-excited state, a moving core is urged by a return spring and thereby the movable contact comes to an open state where the movable contact is separated from a pair of fixed contacts disposed at a predetermined interval. By exciting the exciting coil when the movable contact is in the open state, the moving core is attracted to a fixed core and moved against the return spring. As a result, the movable contact contacts the pair of fixed contacts entering a closed state (see Patent Document 1, for example).

Patent Document 1: Japanese Patent Publication No. 3107288

Incidentally, the electromagnetic device of the conventional example described in Patent Document 1 is configured to have a tubular fixed core disposed on the upper side of a central opening of a coil frame for holding a coil, and a moving core (referred to as "movable plunger" hereinafter) disposed at a predetermined interval from the fixed core while being urged between the fixed core and a yoke by a return spring. The yoke is configured to have a U-shaped yoke main body and a bush installed in a through-hole formed in a central piece of the yoke main body. A non-magnetic bottomed cylindrical body is interposed between the bush and the movable plunger.

Therefore, by exciting the exciting coil in the open state in which the fixed core and the movable plunger are separated away from each other at the predetermined interval and a bottom surface of the movable plunger is inserted in the through-hole of the central piece of the yoke main body, the fixed core attracts the movable plunger and raises the movable plunger. As a result, the movable contact contacts the fixed contact and enters the closed state. However, there is an unsolved problem that, due to the rising of the movable plunger in this closed state, the magnetic flux density between the movable plunger and the yoke main body drops, reducing the attractive force between the fixed core and the movable plunger.

DISCLOSURE OF THE INVENTION

The present invention was contrived in view of the unsolved problem of the conventional example described above, and an object of the present invention is to provide an electromagnetic contactor capable of improving the attractive force applied to a movable plunger when a coil is excited.

In order to achieve the object described above, an electromagnetic contactor according to one aspect of the present invention has a pair of fixed contacts disposed at a predetermined interval; a movable contact placed to be capable of contacting with and separating from the pair of fixed contacts; and an electromagnetic unit driving the movable contact. The electromagnetic unit has a magnetic yoke with a U-shaped cross section having an open upper part; an upper magnetic yoke cross-linked at the open upper part of the magnetic yoke with the U-shaped cross section; a spool with a central opening in which an exciting coil disposed in a bottom plate part of the magnetic yoke with the U-shaped cross section is wound around; a movable plunger movably disposed in the central opening of the spool in an axial direction, having a tip end protruding through an opening formed in the upper magnetic yoke, and urged by a return spring; and an auxiliary yoke forming a magnetic path between the movable plunger and the U-shaped magnetic yoke when the movable plunger is in an open position. The movable plunger is coupled to the movable contact by a coupling shaft.

According to this configuration, in an open state in which the exciting coil is not excited, the movable plunger is urged by the return spring, increasing the gap between a peripheral flange part of the movable plunger and the upper magnetic yoke, as well as the gap between the movable plunger and the yoke with the U-shaped cross section.

When the exciting coil is excited in this open state, the magnetic flux generated by the exciting coil returns to, for example, the upper magnetic yoke via the upper magnetic yoke, the magnetic yoke with the U-shaped cross section, and the movable plunger. At this moment, the gap between the movable plunger and the bottom plate part of the magnetic yoke with the U-shaped cross section is large and provides a large magnetic resistance, reducing the magnetic flux density therebetween.

In this state, however, because the auxiliary yoke fixed to the magnetic yoke with the U-shaped cross section proximally faces a lower end-side outer circumferential surface of the movable plunger, the magnetic flux flows from the magnetic yoke with the U-shaped cross section to the movable plunger through this auxiliary yoke. Consequently, the magnetic flux density between the peripheral flange part of the movable plunger and the upper magnetic yoke that are separated from each other can be increased, and large attractive force can be generated.

Thereafter, when a bottom part of the movable plunger approaches the with the U-shaped cross section magnetic yoke, a magnetic path can be formed directly between the bottom plate part of the magnetic yoke and the bottom part of the movable plunger, generating the attractive force therebetween. As a result, large attractive force combined with the attractive force between the peripheral flange part of the movable plunger and the upper magnetic yoke can be obtained.

It is preferred that, in the electromagnetic contactor described above, the magnetic yoke with the U-shaped cross section be configured from a rectangular bottom plate part and side plate parts bent to extend upward from both ends of the bottom plate part in a longitudinal direction.

According to this configuration, the magnetic yoke with the U-shaped cross section can be formed easily by press working.

Furthermore, it is preferred that, in the electromagnetic contactor described above, the magnetic yoke with a U-shaped cross section be configured of a bottomed tubular body having an open upper end.

According to this configuration, because the magnetic yoke with a U-shaped cross section is configured of a bottomed tubular body, the space can be used efficiently and the whole circumference of the exciting coil wrapped around the spool can be covered uniformly. Consequently, leakage flux can be reduced. Furthermore, the plate thickness of the yoke can be reduced in order to ensure a magnetic path cross-sectional area required in a side surface of the exciting coil.

In addition, it is preferred that, in the electromagnetic contactor described above, the auxiliary yoke be configured of a tubular body that proximally faces an outer circumferential surface of a lower end part of the movable plunger and is fixed to the magnetic yoke with the U-shaped cross section.

According to this configuration, because the auxiliary yoke is configured of a tubular body, the auxiliary yoke can be produced easily and attached easily to the magnetic yoke.

It is preferred that, in the electromagnetic contactor described above, the auxiliary yoke be configured from an annular plate part fixed to a bottom plate part of the bottomed tubular body and having a central opening, and a tubular part formed integrally with an inner circumferential surface of the annular plate part, extending upward, and proximally facing the outer circumferential surface of the lower end part of the movable plunger.

According to this configuration in which the magnetic yoke is configured of the bottomed tubular body, a magnetic path can be formed uniformly over the entire surface of the bottom plate part by attaching the annular plate part to the bottom plate part of the bottomed tubular body.

In the electromagnetic contactor, the auxiliary yoke may be configured from a convex body that has a large diameter part fitted to an opening formed on the bottom plate part of the magnetic yoke with the U-shaped cross section and a small diameter part formed on an upper surface of the large diameter part, the small diameter part being inserted into a concave part formed on a lower surface of the movable plunger to proximally face an inner circumferential surface of the concave part.

According to this configuration, thermal deformation of the auxiliary yoke caused by welding or brazing processing can be prevented by simply fitting and attaching the auxiliary yoke to the opening of the magnetic yoke with the U-shaped cross section.

Furthermore, it is preferred that the electromagnetic contactor described above be configured such that $g1<g2$ and $g3<g4$ are established in the open state of the movable plunger and $g1<g2$ and $g3>g4$ are established in a closed state of the movable plunger, wherein the g1 represents a gap between a peripheral flange part of the movable plunger and the upper magnetic yoke, the g2 is a gap between the outer circumferential surface of the movable plunger and an inner circumferential surface of the opening of the upper magnetic yoke, the g3 is a gap between the movable plunger and the auxiliary yoke, and the g4 is a gap between the bottom surface of the movable plunger and the bottom plate part of the magnetic yoke with the U-shaped cross section.

According to this configuration, when the exciting coil is excited in the open state, the magnetic flux density between the peripheral flange part of the movable plunger and the upper magnetic yoke can be increased, improving the attractive force therebetween. Also, in the closed state, attractive force can be generated between the bottom surface of the movable plunger and the bottom plate part of the magnetic yoke with the U-shaped cross section, generating larger attractive force.

According to the present invention, when the movable plunger is in the open position and the gap between the bottom surface of the movable plunger and the bottom plate part of the magnetic yoke with a U-shaped cross section is large, a magnetic path that extends through the auxiliary yoke can be formed between the movable plunger and the magnetic yoke with a U-shaped cross section. Consequently, the magnetic flux density between the peripheral flange part of the movable plunger and the upper magnetic yoke can be increased, generating large attractive force therebetween.

Thereafter, when the bottom part of the movable plunger approaches the bottom plate part of the magnetic yoke with the U-shaped cross section, a magnetic path can be formed directly between the bottom part of the movable plunger and the bottom plate part of the magnetic yoke with the U-shaped cross section, generating attractive force therebetween. As a result, large attractive force combined with the attractive force between the peripheral flange part of the movable plunger and the upper magnetic yoke can be obtained. Therefore, the movable plunger can be retained in the closed state more strongly.

BEST MODE FOR CARRYING OUT THE INVENTION

Embodiments of the present invention are described hereinafter with reference to the drawings.

Figure 1:
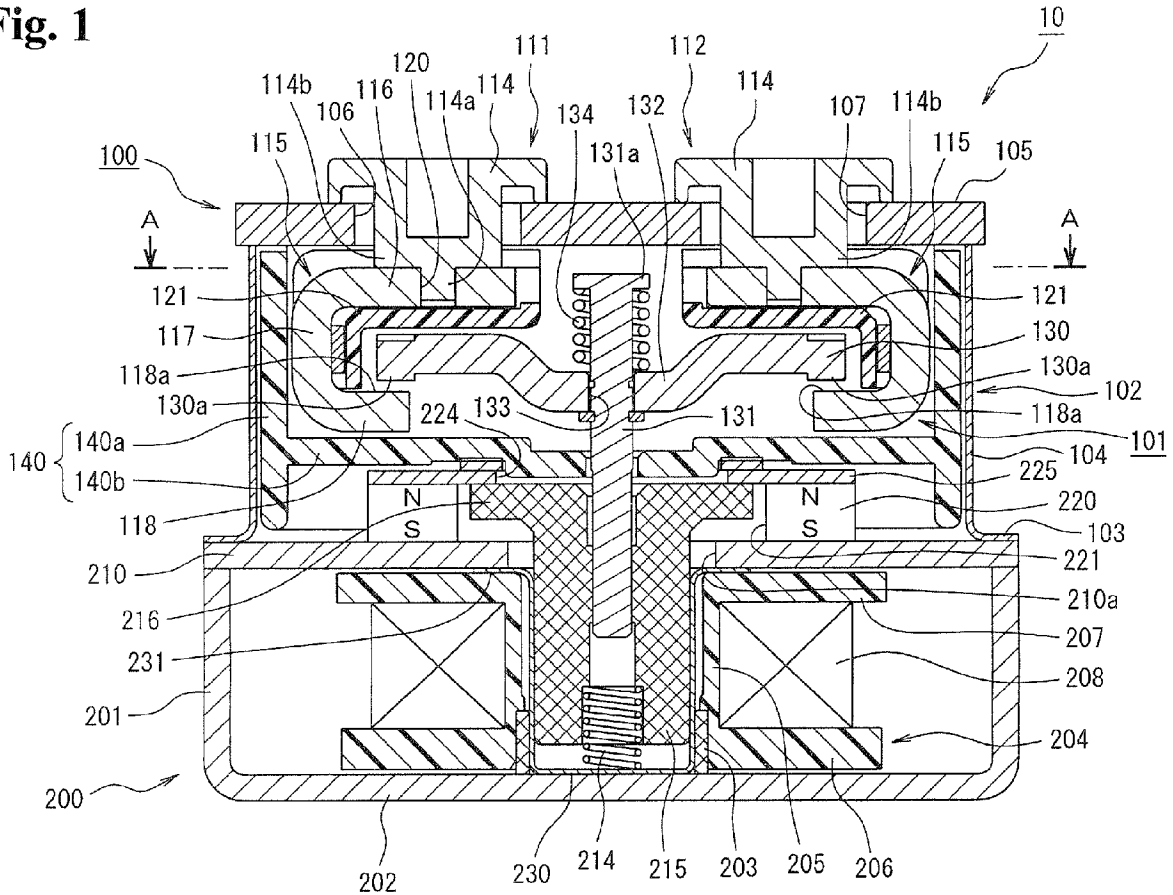
FIG. 1 is a cross-sectional diagram showing an embodiment of an electromagnetic contactor according to the present invention.
Figure 2B:
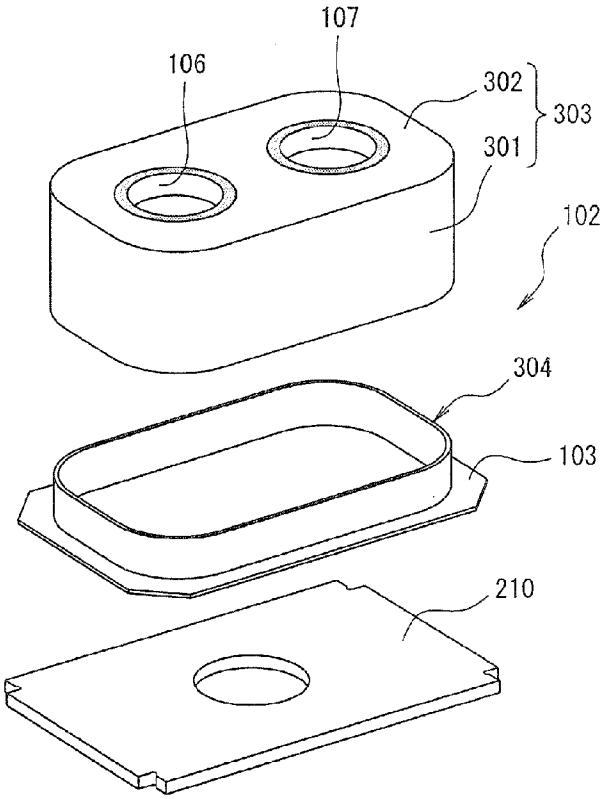
FIGS. 2(*a*)-2(*b*) are exploded perspective views of a contact point storage case.
Figure 2A:
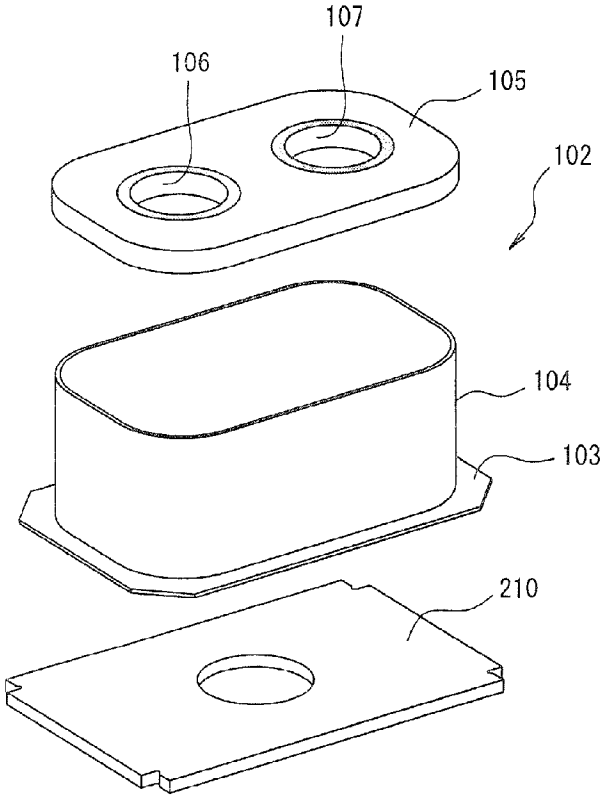

FIG. 1 is a cross-sectional diagram showing an example of an electromagnetic switch according to the present invention. FIGS. 2(*a*), 2(*b*) are exploded perspective views of an arc-extinguishing chamber. Reference numeral 10 shown in FIGS. 1 and 2(*a*), 2(*b*) represents an electromagnetic contactor. The electromagnetic contactor 10 is configured of a contact point device 100 in which a contact point mechanism is disposed, and an electromagnetic unit 200 that drives the contact point device 100.

As it is clear from FIGS. 1 and 2(*a*), 2(*b*), the contact point device 100 has an arc-extinguishing chamber 102 for storing a contact point mechanism 101 therein. As shown in FIG. 2(*a*), this arc-extinguishing chamber 102 has a metallic angular cylindrical body 104 having an outwardly protruding flange part 103 at a metallic lower end part thereof, and a fixed contact point supporting insulating substrate 105, configured of a flat ceramic insulating substrate, for sealing an upper end of the metallic angular cylindrical body 104.

The metallic angular cylindrical body 104 has its flange part 103 seal-bonded and fixed to an upper magnetic yoke 210 of the electromagnetic unit 200, which is described hereinafter.

The fixed contact point supporting insulating substrate 105 has, at a central part thereof, through-holes 106 and 107 disposed at a predetermined interval to allow a pair of fixed contacts 111 and 112 to be inserted thereto, the pair of fixed contacts 111 and 112 being described hereinafter. The periphery of the through-holes 106 and 107 formed on an upper surface of the fixed contact point supporting insulating substrate 105 and a position on a lower surface of the fixed contact point supporting insulating substrate 105 that contacts the angular cylindrical body 104 are metalized. This metallization is done by forming metal foil (e.g., copper foil) in the periphery of the through-holes 106 and 107 and the position contacting with the angular cylindrical body 104, while arranging a plurality of the fixed contact point supporting insulating substrates 105 in a matrix in a plane.

As shown in FIG. 1, the contact point mechanism 101 has a pair of the fixed contacts 111 and 112 that are inserted into and fixed to the through-holes 106 and 107 of the fixed contact point supporting insulating substrate 105 of the arc-extinguishing chamber 102. Each of the fixed contacts 111 and 112 has a support conductor 114 that is inserted into the through-hole 106 or 107 of the fixed contact point supporting insulating substrate 105 and has an outwardly protruding flange part at its upper end, and a C-shaped part 115 that is coupled to the support conductor 114, placed on the lower-surface side of the fixed contact point supporting insulating substrate 105, and has an open inner side.

The C-shaped part 115 has an upper plate part 116 extending outward along the lower surface of the fixed contact point supporting insulating substrate 105, an intermediate plate part 117 extending downward from an outer end part of the upper plate part 116, and a lower plate part 118 extending inward from a lower end of the intermediate plate part 117 to be parallel with the upper plate part 116 and to face the fixed contact 111, 112. The C-shaped part 115 is so formed by adding the upper plate part 116 to the L-shape formed by the intermediate plate part 117 and the lower plate part 118.

The support conductor 114 and the C-shaped part 115 are, for example, brazed and fixed to each other by inserting a pin 114*a* of the support conductor 114 into a through-hole 120 formed on the upper plate part 116 of the C-shaped part 115, the pin 114*a* being formed in a protruding manner on a lower end surface of the support conductor 114. The support conductor 114 and the C-shaped part 115 may be fixed not only by brazing processing but also by fitting the pin 114*a* and the through-hole 120 together or by forming a male screw on the pin 114*a*, forming a female screw on the through-hole 120, and then screwing them together.

Figure 3A:
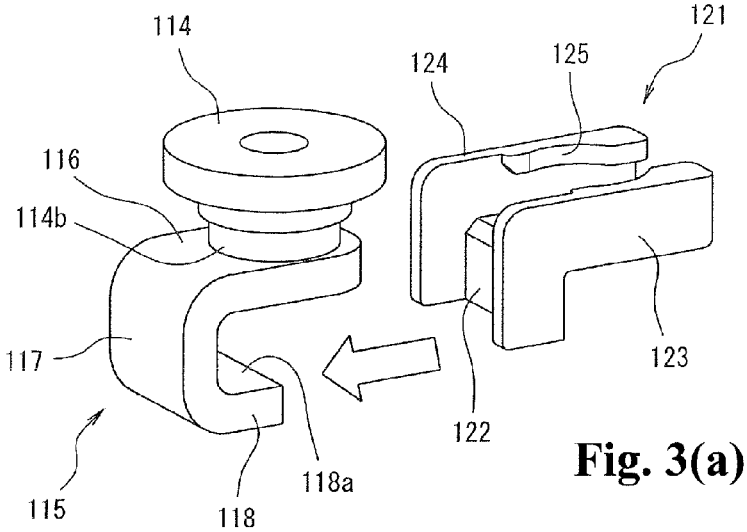
FIGS. 3(*a*)-3(*c*) show diagrams of an insulation cover of a contact point device wherein FIG. 3(*a*) is a perspective view, FIG. 3(*b*) is a plan view showing a state prior to installment, and FIG. 3(*c*) is a plan view showing a state after installment.
Figure 3B:
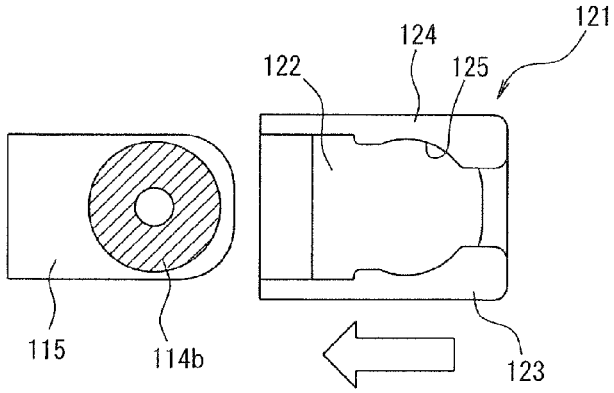
Figure 3C:
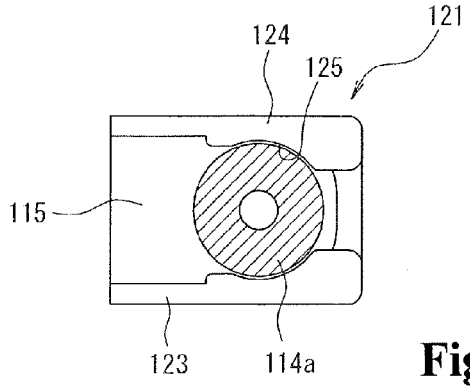

A synthetic-resin insulation cover 121 for restricting generation of an arc is installed in each of the C-shaped parts 115 of the fixed contacts 111 and 112. This insulation cover 121 covers inner circumferential surfaces of the upper plate part 116 and the intermediate plate part 117 of the C-shaped part 115, as shown in FIGS. 3(*a*) and 3(*b*). The insulation cover 121 has an L-shaped plate part 122 formed along the inner circumferential surfaces of the upper plate part 116 and the intermediate plate part 117, side plate parts 123 and 124 that extend upward and outward from front and rear end parts of the L-shaped plate part 122 to cover side surfaces of the upper plate part 116 and the intermediate plate part 117 of the C-shaped part 115, and fitted parts 125 that extend inward from upper ends of the side plate parts 123 and 124 to be fitted to a small diameter part 114*b* formed in the support conductor 114 of the fixed contact 111, 112.

Therefore, the fitted parts 125 are positioned to face the small diameter part 114*b* of the support conductor 114 of the fixed contact 111, 112 as shown in FIGS. 3(*a*) and 3(*b*), and then the insulation cover 121 is pushed so that the fitted parts 125 are engaged with the small diameter part 114*b* of the support conductor 114, as shown in FIG. 3(*c*).

Figure 4A:
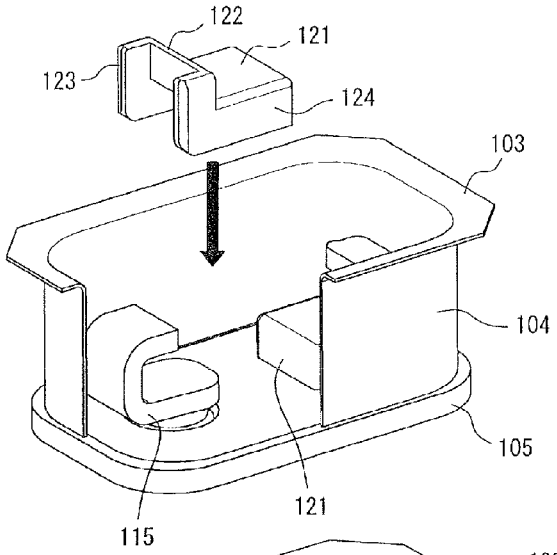
FIGS. 4(*a*)-4(*c*) are explanatory diagrams showing a method for installing the insulation cover.
Figure 4B:
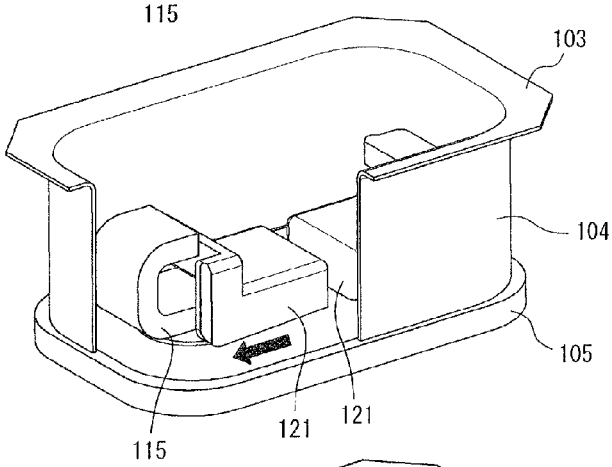
Figure 4C:
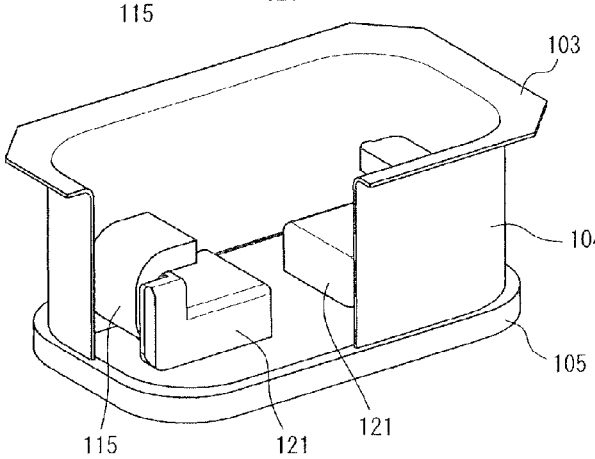

Practically, the arc-extinguishing chamber 102 with the fixed contacts 111 and 112 attached thereto is inserted between the fixed contacts 111 and 112, with the fixed contact point supporting insulating substrate 105 kept down and the insulation cover 121, which is flipped from the state shown in FIGS. 3(*a*) to 3(*c*), placed in an upper opening part of the angular cylindrical body 104, as shown in FIG. 4(*a*). Subsequently, while the fitted parts 125 contact the fixed contact point supporting insulating substrate 105 as shown in FIG. 4(*b*), the insulation cover 121 is pushed outward, allowing the fitted parts 125 to come into engagement with the small diameter part 114*b* of the support conductor 114 of the fixed contact 111 and 112, as shown in FIG. 4(*c*).

By installing the insulation cover 121 in the C-shaped part 115 of the fixed contact 111, 112 as described above, only an upper surface of the lower plate part 118 is exposed on an inner circumferential surface of the C-shaped part 115, forming a contact point part 118*a*.

Figure 5:
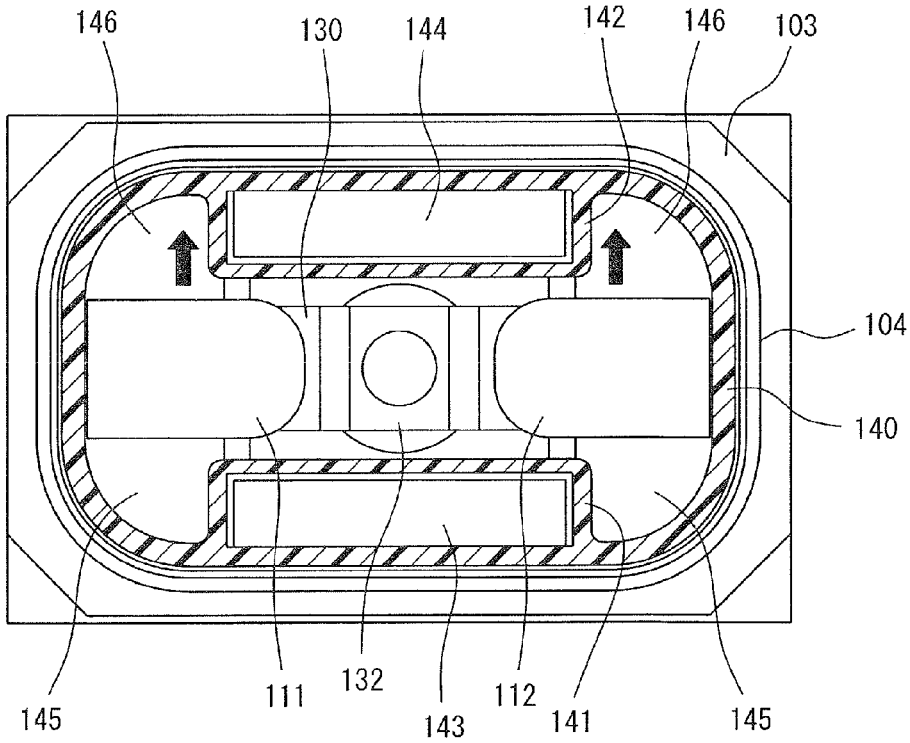
FIG. 5 is a cross-sectional diagram taken along line A-A shown in FIG. 1.

A movable contact 130 is placed to dispose both end parts thereof in the C-shaped parts 115 of the fixed contacts 111 and 112. This movable contact 130 is supported by a coupling shaft 131 fixed to a movable plunger 215 of the electromagnetic unit 200, the movable plunger 215 being described hereinafter. As shown in FIGS. 1 and 5, the movable contact 130 has a concave part 132 formed by causing the vicinity of the coupling shaft 131 in the middle to protrude downward, and a through-hole 133 through which the coupling shaft 131 is inserted into the concave part 132. A flange part 131*a* that protrudes outward is formed at an upper end of the coupling shaft 131. A lower end of the coupling shaft 131 is inserted into a contact spring 134, and the through-hole 133 is pierced in the movable contact 130. An upper end of the contact spring 134 abuts against the flange part 131*a*, and thereby the movable contact 130 is positioned using, for example, a C-ring 135 so as to obtain a predetermined urging force of the contact spring 134.

This movable contact 130 is in an open state when contact point parts 130*a* on both ends of the movable contact 130 and the contact point parts 118*a* of the lower plate parts 118 of the C-shaped parts 115 of the fixed contacts 111 and 112 are separated from each other with a predetermined interval therebetween. The movable contact 130 is in a closed state when the contact point parts on both ends of the movable contact 130 contact the contact point parts 118*a* of the lower plate part 118 of the C-shaped parts 115 of the fixed contacts 111 and 112 by a predetermined contact pressure of the contact spring 134.

Furthermore, an insulating cylindrical body 140 made of, for example, synthetic resin, placed on an inner circumferential surface of the angular cylindrical body 104 of the arc-extinguishing chamber 102. This insulating cylindrical body 140 is configured from an angular cylindrical part 140*a* on the inner circumferential surface of the angular cylindrical body 104 and a bottom plate part 140*b* that seals a lower surface of the angular cylindrical body 140*a*. As shown in FIG. 5, magnetic storage pockets 141 and 142 are formed on inner circumferential surfaces of the angular cylindrical part 140*a* of the insulating cylindrical body 140 that face side surfaces of the movable contact 130. The magnetic storage pockets 141 and 142 are fixed by having permanent magnets for arc extinguishing 143 and 144 inserted thereto.

The permanent magnets for arc extinguishing 143 and 144 are magnetized such that their surfaces facing each other have the same polarity, such as the N pole, in a thickness direction. As shown in FIG. 5, in each of the permanent magnets for arc extinguishing 143 and 144, its end parts in a lateral direction is positioned slightly inward from the position where the contact point part 118*a* of the fixed contact 111 and 112 and the contact point part of the movable contact 130 face each other. Arc-extinguishing spaces 145 and 146 are formed on the outside of each of the magnetic storage packets 141 and 142 in the lateral direction.

The permanent magnets for arc extinguishing 143 and 144 can be brought close to the movable contact 130 by disposing the permanent magnets for arc extinguishing 143 and 144 on the inner circumferential surfaces of the insulating cylindrical body 140. Therefore, magnetic fluxes $\phi$ that are generated from the N poles of the permanent magnets for arc extinguishing 143 and 144 pass across the part where the contact point part 118*a* of the fixed contact 111 and 112 and the contact point part 130*a* of the movable contact 130 face each other, from the inside to the outside in the lateral direction, at a large magnetic flux density, as shown in FIG. 6(*a*).

Figure 6A:
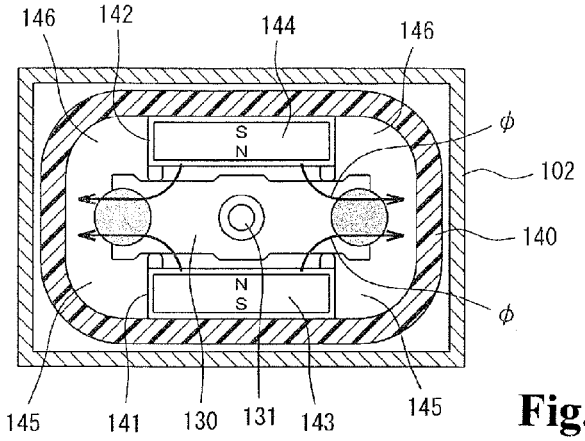
FIGS. 6(*a*)-6(*c*) are explanatory diagrams illustrating arc extinguishing performed by a permanent magnet for arc extinguishing according to the present invention.
Figure 6B:
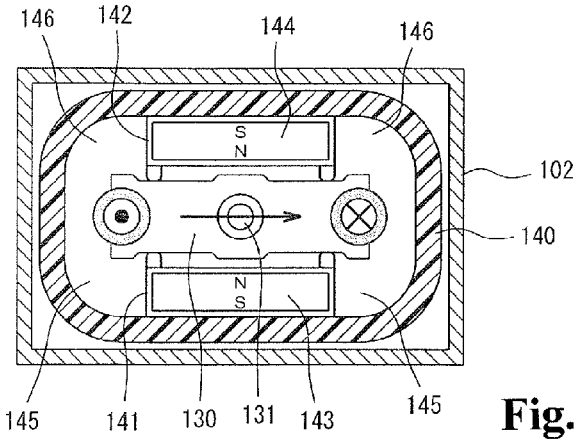
Figure 6C:
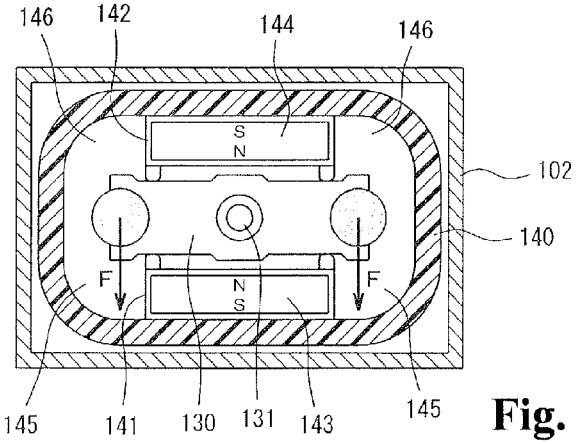

Therefore, when connecting the fixed contact 111 to a current supply source and the fixed contact 112 to the load side, a current flows from the fixed contact 111 to the fixed contact 112 through the movable contact 130 during the closed state, as shown FIG. 6(*b*). When the closed state is changed to the open state in which the movable contact 130 is moved upward away from the fixed contacts 111 and 112, an arc is generated between the contact point parts 118*a* of the fixed contacts 111 and 112 and the contact point parts 130*a* of the movable contact 130.

This arc is stretched to the arc-extinguishing space 145 on the permanent magnet for arc extinguishing 143 side, due to the magnetic fluxes $\phi$ generated from the permanent magnets for arc extinguishing 143 and 144. At this moment, because the arc-extinguishing spaces 145 and 146 are formed to be as wide as the thickness of the permanent magnets for arc extinguishing 143 and 144, a long arc can be obtained, thereby extinguishing the arc reliably.

Figure 7A:
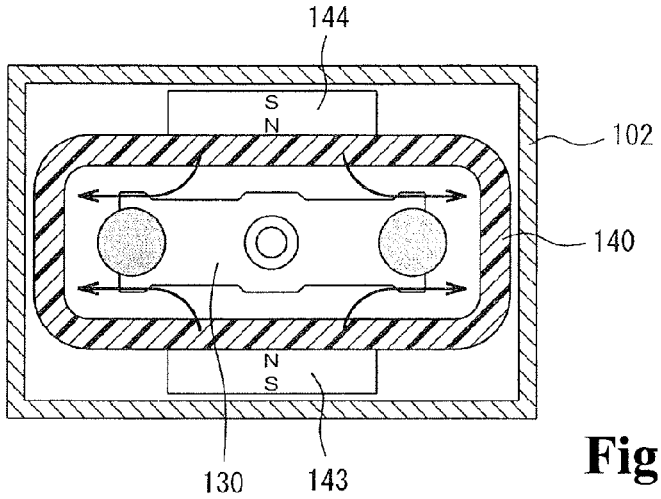
FIGS. 7(*a*)-7(*c*) are explanatory diagrams illustrating arc extinguishing performed when the permanent magnet for arc extinguishing is disposed outside an insulation case.
Figure 7B:
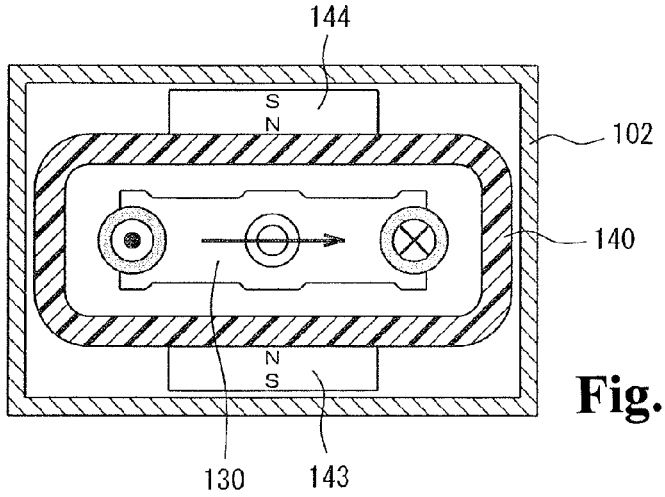
Figure 7C:
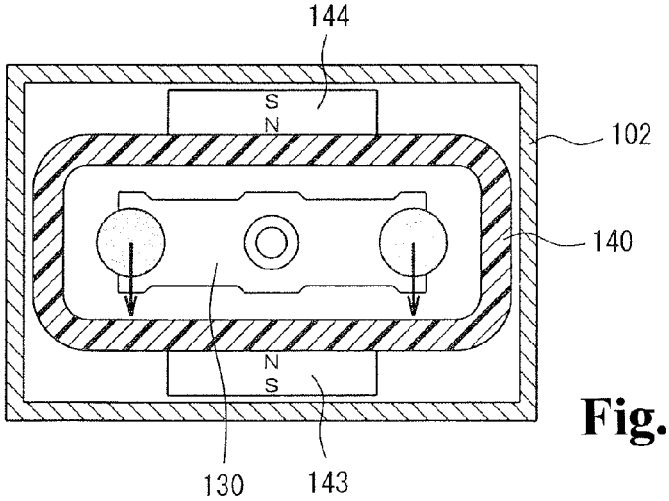

Incidentally, disposing the permanent magnets for arc extinguishing 143 and 144 outside the insulating cylindrical body 140 as shown in FIGS. 7(*a*) to 7(*c*) increases the distance between each of the permanent magnets for arc extinguishing 143 and 144 and the position where the contact point parts 118*a* of the fixed contacts 111 and 112 and the contact point parts 130*a* of the movable contact 130 face each other, reducing the magnetic flux density of the magnetic flux passing across the arc when permanent magnets same as those of the present embodiment are applied.

This consequently reduces the Lorentz force that acts on the arc generated when the closed state is changed to the open state. As a result, the arc cannot be stretched sufficiently. The level of magnetization between the permanent magnets for arc extinguishing 143 and 144 needs to be increased in order to improve the ability to extinguish the arc.

Moreover, the width of the insulating cylindrical body 140 in a front-back direction needs to be narrowed in order to reduce the distance between each of the permanent magnets for arc extinguishing 143 and 144 and the contact point parts of the movable contact 130 with the fixed contacts 111 and 112. However, doing so cannot secure a sufficient arc-extinguishing space for extinguishing the arc.

According to this embodiment, however, because the permanent magnets for arc extinguishing 143 and 144 are disposed on the inside of the insulating cylindrical body 140, the problems that are generated as a result of disposing the permanent magnets for arc extinguishing 143 and 144 on the outside of the insulating cylindrical body 140 can be solved completely.

The electromagnetic unit 200 has a magnetic yoke 201 with a U-shaped cross section that is flat when viewed from the side, and has a tubular auxiliary yoke 203 fixed at a central part of a bottom plate part 202 of the magnetic yoke 201, as shown in FIG. 1. A spool 204 functioning as a plunger drive part is disposed on the outside of the tubular auxiliary yoke 203.

This spool 204 is configured from a central tubular part 205 into which the tubular auxiliary yoke 203 is inserted, a lower flange part 206 that protrudes radially outward from a lower end part of the central tubular part 205, and an upper flange part 207 that protrudes radially outward from a section slightly below an upper end of the central tubular part 205. An exciting coil 208 is wrapped in a storage space configured from the central tubular part 205, the lower flange part 206, and the upper flange part 207.

An upper magnetic yoke 210 is fixed between upper ends of the magnetic yoke 201 that are open. At a central part of the upper magnetic yoke 210, a through-hole 210*a* is formed facing the central tubular part 205 of the spool 204.

The movable plunger 215 is vertically slidably placed in the central tubular part 205 of the spool 204, the movable plunger 215 having a return spring 214 placed between a bottom part of the movable plunger 215 and the bottom plate part 202 of the magnetic yoke 201. A peripheral flange part 216 that protrudes radially outward is formed at an upper end part of the movable plunger 215, which protrudes upward from the upper magnetic yoke 210.

An annular permanent magnet 220 is fixed to an upper surface of the upper magnetic yoke 210 so as to surround the peripheral flange part 216 of the movable plunger 215. The permanent magnet 220 has a through-hole 221 surrounding the peripheral flange part 216. The permanent magnet 220 is magnetized, with its upper end configured as, for example, the N pole and lower end as the S pole in terms of its vertical direction or thickness direction. Note that the shape of the through-hole 221 of the permanent magnet 220 matches the shape of the peripheral flange part 216 and that an outer circumferential surface of the through-hole 221 can be formed into a circular, square or any shape.

An auxiliary yoke 225 is fixed to an upper end surface of the permanent magnet 220. The auxiliary yoke 225 has the same shape as the permanent magnet 220 and has a through-hole 224 whose inner diameter is smaller than an outer diameter of the peripheral flange part 216 of the movable plunger 215. The peripheral flange part 216 of the movable plunger 215 faces a lower surface of the auxiliary yoke 225.

Figure 8:
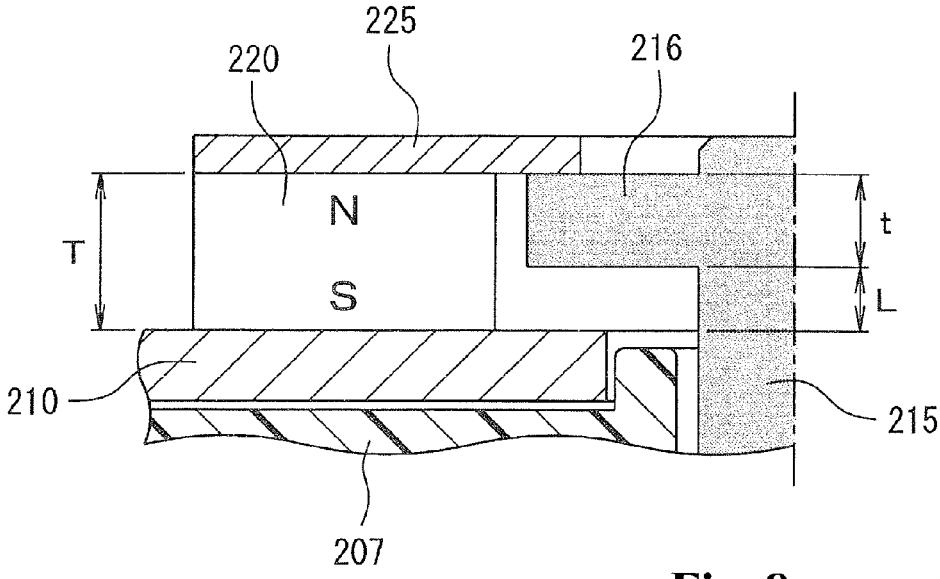
FIG. 8 is an enlarged cross-sectional diagram showing a positional relationship between the permanent magnet and a movable plunger.

As shown in FIG. 8, thickness T of the permanent magnet 220 is set at a value obtained by adding up a stroke L of the movable plunger 215 and a thickness t of the peripheral flange part 216 of the movable plunger 215 (T=L+t). Therefore, the stroke L of the movable plunger 215 is restricted by the thickness T of the permanent magnet 220. Accordingly, the cumulative number of parts or form tolerance that affects the stroke of the movable plunger 215 can be minimized.

The stroke L of the movable plunger 215 can be determined only by the thickness T of the permanent magnet 220 and the thickness t of the peripheral flange part 216, and fluctuations of the stroke L can be minimized. The determination on the stroke and minimizing the fluctuations can be performed particularly effectively in a small electromagnetic contactor with a small stroke.

Additionally, due to the annular shape of the permanent magnet 220, the number of parts and the costs can be reduced more than in the technology disclosed in Patent Document 1 where two permanent magnets are disposed symmetrically. Furthermore, because the peripheral flange part 216 of the movable plunger 215 is placed in the vicinity of an inner circumferential surface of the through-hole 221 formed in the permanent magnet 220, a closed circuit that allows the passage of a magnetic flux generated from the permanent magnet 220 can be used efficiently and leakage flux can be reduced. Thus, the magnetic force of the permanent magnet can be used efficiently.

The coupling shaft 131 supporting the movable contact 130 is screwed to an upper end surface of the movable plunger 215.

In the open state, the movable plunger 215 is urged upward by the return spring 214 and brought to an open position in which an upper surface of the peripheral flange part 216 abuts against the lower surface of the auxiliary yoke 225. In this state, the contact point part 130*a* of the movable contact 130 is moved upward away from the contact point part 118*a* of the fixed contact 111 and 112, creating a current interruption state.

In this open state, the peripheral flange part 216 of the movable plunger 215 is attracted to the auxiliary yoke 225 by the magnetic force of the permanent magnet 220, and, in combination with the urging force of the return spring 214, the movable plunger 215 is kept abutted against the auxiliary yoke 225 without being carelessly moved downward by an external vibration or impact.

Figure 9A:
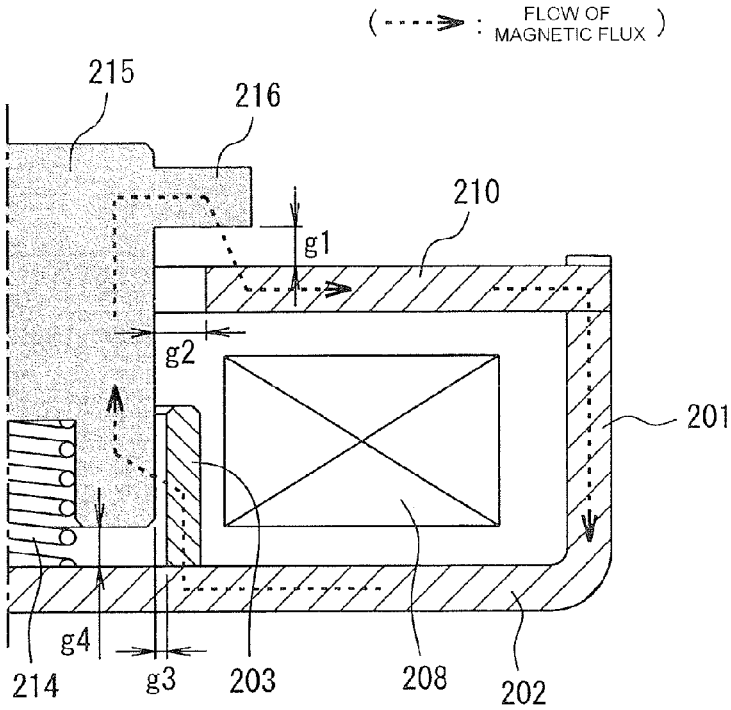
FIGS. 9(*a*)-9(*b*) show diagrams illustrating an operation for attracting the movable plunger that is performed by the permanent magnet, wherein FIG. 9(*a*) is a partial cross-sectional diagram showing an open state and FIG. 9(*b*) is a partial cross-sectional diagram showing a closed state.
Figure 9B:
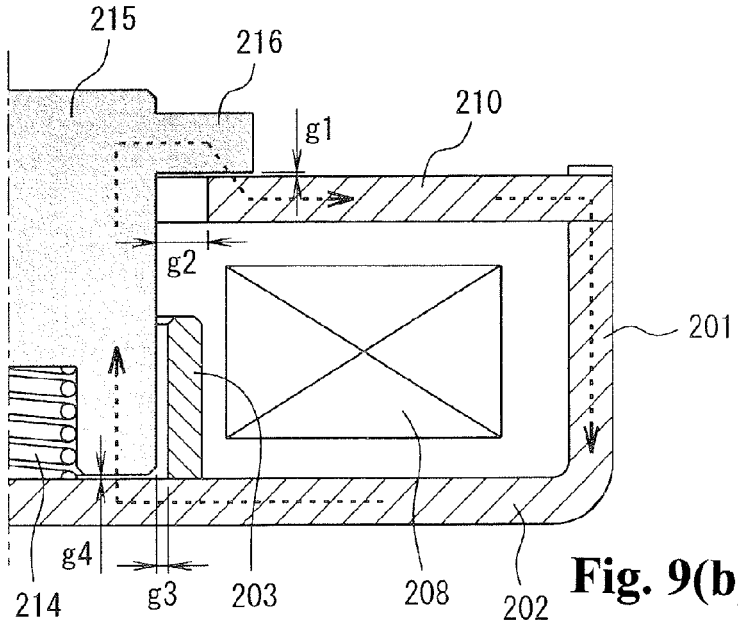

As shown in FIG. 9(*a*), in the open state, a relation among a gap g1 between a lower surface of the peripheral flange part 216 of the movable plunger 215 and the upper surface of the upper magnetic yoke 210, a gap g2 between an outer circumferential surface of the movable plunger 215 and the through-hole 210*a* of the upper magnetic yoke 210, a gap g3 between the outer circumferential surface of the movable plunger 215 and the tubular auxiliary yoke 203, and a gap g4 between a lower surface of the movable plunger 215 and an upper surface of the bottom plate part 202 of the magnetic yoke 201, is established as follows.

$$g1<g2 \text{ and } g3<g4$$

Therefore, when the exciting coil 208 is excited in the open state, as shown in FIG. 9(*a*) the current moves from the movable plunger 215 to the upper magnetic yoke 210 through the peripheral flange part 216 and then through the gap g1 between the peripheral flange part 216 and the upper magnetic yoke 210. Therefore, a closed magnetic path is foiled in which the current moves from the upper magnetic yoke 210 to the movable plunger 215 through the magnetic yoke 201 with the U-shaped cross section and the tubular auxiliary yoke 203.

Thus, the magnetic flux density of the gap g1 between the lower surface of the peripheral flange part 216 of the movable plunger 215 and the upper surface of the upper magnetic yoke 210 can be increased, whereby larger attractive force is generated so that the movable plunger 215 is dropped against the urging force of the return spring 214 and the attractive force of the permanent magnet 220.

Therefore, the contact point part 130*a* of the movable contact 130 coupled to the movable plunger 215 via the coupling shaft 131 contacts the contact point part 118*a* of the fixed contact 111, 112, and a path of current is formed from the fixed contact 111 toward the fixed contact 112 through the movable contact 130. As a result, the closed state is established.

In this closed state, a lower end surface of the movable plunger 215 approaches the bottom plate part 202 of the magnetic yoke 201 with U-shaped cross section, as shown in FIG. 9(*b*). Consequently, the abovementioned gaps g1 to g4 establish the following relations:

$$g1<g2 \text{ and } g3>g4.$$

Accordingly, the magnetic flux that is generated by the exciting coil 208 directly enters the upper magnetic yoke 210 from the movable plunger 215 through the peripheral flange part 216, as shown in FIG. 9(*b*), passes through the magnetic yoke 201 with the U-shaped cross section from the upper magnetic yoke 210, and directly returns from the bottom plate part 202 to the movable plunger 215, forming the closed magnetic path.

As a result, large attractive force acts on both the gap g1 and the gap g4, securely keeping the movable plunger 215 dropped. Therefore, the contact point part 130*a* of the movable contact 130 coupled to the movable plunger 215 via the coupling shaft 131 is kept in contact with the contact point part 118*a* of the fixed contact 111 and 112.

The movable plunger 215 is covered with a non-magnetic cap 230 in the shape of a cylinder with a bottom, and a flange part 231 that extends radially outward to an open end of the cap 230 is seal-bonded to a lower surface of the upper magnetic yoke 210. This configuration forms an airtight container in which the arc-extinguishing chamber 102 and the cap 230 are communicated to each other via the through-hole 210*a* of the upper magnetic yoke 210. This airtight container formed by the arc-extinguishing chamber 102 and the cap 230 is filled with hydrogen gas, nitrogen gas, mixed gas of hydrogen and nitrogen, air, $SF_6$, or other type of gas.

Operations of the present embodiment are described next.

Suppose that the fixed contact 111 is connected to, for example, a power supply source for supplying large current, and that the fixed contact 112 is connected to a load.

Suppose, in this state, that the exciting coil 208 of the electromagnetic unit 200 is in a non-excited state, or the open state in which no excitation force for lowering the movable plunger 215 in the electromagnetic unit 200 is generated. In this open state, the movable plunger 215 is urged upward by the return spring 214 to separate from the upper magnetic yoke 210. At the same time, the attractive force that is generated from the magnetic force of the permanent magnet 220 acts on the auxiliary yoke 225 to attract the peripheral flange part 216 of the movable plunger 215. Consequently, the upper surface of the peripheral flange part 216 of the movable plunger 215 abuts against the lower surface of the auxiliary yoke 225.

Thus, the contact point part 130*a* of the movable contact 130 of the contact point mechanism 101, which is coupled to the movable plunger 215 by the coupling shaft 131, is moved upward away from the contact point part 118*a* of the fixed contact 111 and 112 by a predetermined distance. As a result, the current path between the fixed contacts 111 and 112 enters the interruption state, and the contact point mechanism 101 enters an open pole state.

In the open state, because both the urging force of the return spring 214 and the attractive force of the annular permanent magnet 220 act on the movable plunger 215, malfunctions can reliably be prevented without carelessly allowing the movable plunger 215 to be dropped by external vibration or impact.

When the exciting coil 208 of the electromagnetic unit 200 is excited in this open state, the excitation force is generated in the electromagnetic unit 200, pushing the movable plunger 215 down against the urging force of the return spring 214 and the attractive force of the annular permanent magnet 220.

At this moment, because the gap g4 between a bottom surface of the movable plunger 215 and the bottom plate part 202 of the magnetic yoke 201 is wide as shown in FIG. 9(*a*), there is almost no magnetic flux passing through the gap g4.

However, the tubular auxiliary yoke 203 faces a lower outer circumferential surface of the movable plunger 215, and the gap g3 between the outer circumferential surface of the movable plunger 215 and the tubular auxiliary yoke 203 is set to be relatively smaller than the gap g4. Therefore, a magnetic path can be formed between the movable plunger 215 and the bottom plate part 202 of the magnetic yoke 201 via the tubular auxiliary yoke 203.

Further, the gap g1 between the lower surface of the peripheral flange part 216 of the movable plunger 215 and the upper magnetic yoke 210 is set to be smaller than the gap g2 between the outer circumferential surface of the movable plunger 215 and an inner circumferential surface of the through-hole 210*a* of the upper magnetic yoke 210. For this reason, the magnetic flux density between the lower surface of the peripheral flange part 216 of the movable plunger 215 and the upper surface of the upper magnetic yoke 210 increases, and large attractive force for attracting the peripheral flange part 216 of the movable plunger 215 acts.

Therefore, the movable plunger 215 is immediately dropped against the urging force of the return spring 214 and the attractive force of the annular permanent magnet 220. After the lower surface of the peripheral flange part 216 abuts against the upper surface upper magnetic yoke 210, the dropping movable plunger 215 is stopped, as shown in FIG. 9(*b*).

As a result of dropping the movable plunger 215, the movable contact 130 that is coupled to the movable plunger 215 by the coupling shaft 131 is also dropped, whereby the contact point part 130*a* contacts the contact point part 118*a* of the fixed contact 111 and 112 by the contact pressure of the contact spring 134.

As a result, a closed pole state is established in which a large current of the external power supply source is supplied to the load through the fixed contact 111, the movable contact 130, and the fixed contact 112.

At this moment, electromagnetic repulsive force acting in a direction of opening the movable contact 130 is generated between the movable contact 130 and the fixed contacts 111 and 112.

However, because the C-shaped part 115 is formed from the upper plate part 116, the intermediate plate part 117, and the lower plate part 118 in each of the fixed contacts 111 and 112, as shown in FIG. 1, the directions of current flowing in the upper plate part 116 and the lower plate part 118 become opposite to the direction of current flowing in the movable contact 130 facing the upper plate part 116 and the lower plate part 118.

Therefore, according to the relationship between a magnetic field formed by the lower plate part 118 of the fixed contact 111 and 112 and the current flowing in the movable contact 130, the Lorentz force that presses the movable contact 130 against the contact point part 118*a* of the fixed contact 111, 112 can be generated based on the Fleming's left-hand rule.

This Lorentz force can act against the electromagnetic repulsive force in the open pole direction that is generated between the contact point part 118*a* of the fixed contact 111, 112 and the contact point part 130*a* of the movable contact 130, reliably preventing the contact point part 130*a* of the movable contact 130 from opening.

As a result, pressing force of the contact spring 134 supporting the movable contact 130 can be reduced. Accordingly, a thrust that is generated in the exciting coil 208 can be lowered, reducing the size of the configuration of the entire electromagnetic contactor.

When shutting off the supply of current to the load in the closed pole state of the contact point mechanism 101, excitation of the exciting coil 208 of the electromagnetic unit 200 is stopped.

As a result, the exciting force for moving the movable plunger 215 of the electromagnetic unit 200 downward disappears. Consequently, the attractive force of the annular permanent magnet 220 increases as the movable plunger 215 is lifted up by the urging force of the return spring 214 and the peripheral flange part 216 approaches the auxiliary yoke 225.

As a result of lifting up the movable plunger 215, the movable contact 130, which is coupled the movable plunger 215 by the coupling shaft 131, is lifted up. In response to this action, the movable contact 130 contacts the fixed contacts 111 and 112, while the contact pressure is applied thereto by the contact spring 134. Subsequently, as soon as the contact pressure of the contact spring 134 disappears, an open pole starting state is set in which the movable contact 130 moves upward to separate from the fixed contacts 111 and 112.

Once this open pole starting state begins, an arc is generated between the contact point part 118*a* of the fixed contact 111, 112 and the contact point part 130*a* of the movable contact 130, and the current is constantly applied by the arc.

At this moment, due to the installation of the insulation cover 121 for covering the upper plate part 116 and the intermediate plate part 117 of the C-shaped part 115 of the fixed contact 111, 112, an arc can be generated only between the contact point part 118*a* of the fixed contact 111, 112 and the contact point part 130*a* of the movable contact 130. Thus, the arc can be generated stably, improving the ability to extinguish the arc.

Moreover, because the pole faces of the permanent magnets for arc-extinguishing 143 and 144 that face each other are the N poles and the faces on the other side are the S poles, the magnetic fluxes that are generated from the N poles pass across an arc generation part of the part where the contact point part 118*a* of the fixed contact 111 and the contact point part 130*a* of the movable contact 130 face each other, from the inside to the outside in a longitudinal direction of the movable contact 130, and reach the S poles, as shown in the plan view in FIG. 6(*a*), thereby forming a magnetic field.

Similarly, the magnetic fluxes pass across an arc generation part between the contact point part 118*a* of the fixed contact 112 and the contact point part 130*a* of the movable contact 130, from the inside to the outside in the longitudinal direction of the movable contact 130, and reach the S poles, thereby forming a magnetic field.

Therefore, the magnetic fluxes of the permanent magnets for arc extinguishing 143 and 144 pass across the part between the contact point part 118*a* of the fixed contact 111 and the contact point part 130*a* of the movable contact 130 and the part between the contact point part 118*a* of the fixed contact 112 and the contact point part 130*a* of the movable contact 130 in directions opposite to each other in the longitudinal direction of the movable contact 130.

Thus, between the contact point part 118*a* of the fixed contact 111 and the contact point part 130*a* of the movable contact 130, current I flows from the fixed contact 111 side to the movable contact 130 side, as shown in FIG. 6(*b*), and the magnetic flux ϕ is directed from the inside to the outside. As a result, large Lorentz force F is generated based on the Fleming's left-hand rule to act toward the arc-extinguishing space 145 in a direction perpendicular to the longitudinal direction of the movable contact 130 and an opening/closing direction of the contact point part 118*a* of the fixed contact 111 and the movable contact 130, as shown in FIG. 6(*c*).

The arc that is generated between the contact point part 118*a* of the fixed contact 111 and the contact point part 130*a* of the movable contact 130 is stretched significantly so as to reach an upper surface of the movable contact 130 from a side surface of the contact point part 118*a* of the fixed contact 111 through the arc-extinguishing space 145 and extinguished by this Lorentz force F.

In the arc-extinguishing space 145, the magnetic flux is inclined toward the lower side and the upper side with respect to the direction of the magnetic flux between the contact point part 118*a* of the fixed contact 111 and the contact point part 130*a* of the movable contact 130. Therefore, the arc that is stretched to the arc-extinguishing space 145 can be further stretched to the corners of the arc-extinguishing space 145 and lengthened by the inclined magnetic flux, realizing favorable interruption performance.

Between the contact point part 118*a* of the fixed contact 112 and the movable contact 130, on the other hand, the current I flows from the movable contact 130 side to the fixed contact 112 side, and the magnetic flux ϕ is directed to the right, i.e., from the inside to the outside, as shown in FIG. 6(*b*). As a result, large Lorentz force F is generated based on the Fleming's left-hand rule to act toward the arc-extinguishing space 145 in a direction perpendicular to the longitudinal direction of the movable contact 130 and an opening/closing direction of the contact point part 118*a* of the fixed contact 112 and the movable contact 130.

The arc that is generated between the contact point part 118*a* of the fixed contact 112 and the movable contact 130 is stretched significantly so as to reach a side surface of the fixed contact 112 from the upper surface of the movable contact 130 through the arc-extinguishing space 145 and extinguished by this Lorentz force F.

In the arc-extinguishing space 145, as described above, the magnetic flux is inclined toward the lower side and the upper side with respect to the direction of the magnetic flux between the contact point part 118*a* of the fixed contact 112 and the contact point part 130*a* of the movable contact 130. Therefore, the arc that is stretched to the arc-extinguishing space 145 can be further stretched to the corners of the arc-extinguishing space 145 and lengthened by the inclined magnetic flux, realizing favorable interruption performance.

On the other hand, when changing the state of the electromagnetic contactor 10 to the open state from the closed state where a regenerative current flows from the load to a DC power source, the direction of the current inverts, as shown in FIG. 6(*b*). Therefore, the same arc extinguishing function is exerted, except that Lorentz force F acts on the arc-extinguishing space 146 and that the arc is stretched toward the arc-extinguishing space 146.

Because the permanent magnets for arc extinguishing 143 and 144 are disposed in the magnetic storage pockets 141 and 142 formed in the insulating cylindrical body 140, the arc does not directly contact the permanent magnets for arc extinguishing 143 and 144. For this reason, the magnetic characteristics of the permanent magnets for arc extinguishing 143 and 144 can be maintained stably, stabilizing the interruption performance.

Furthermore, because the inner circumferential surface of the metallic angular cylindrical body 104 can be covered and insulated by the insulating cylindrical body 140, the arc can be prevented from shorting during current interruption. Thus, the current interruption can be achieved reliably.

In addition, because the single insulating cylindrical body 140 can determine the positions of the permanent magnets for arc extinguishing 143 and 144 and protect the permanent magnets for arc extinguishing 143 and 144 from an arc, the production costs can be lowered.

According to the embodiment described above, in the contact point device 100 the C-shaped parts 115 of the fixed contacts 111 and 112 and the contact spring 134 of the movable contact 130 for applying the contact pressure are disposed in parallel. Therefore, compared to Patent Document 1 described above where the fixed contact, the movable contact, and the contact spring are disposed in series, the height of the contact point mechanism 101 can be reduced. As a result, the size of the contact point mechanism 100 can be reduced.

Also, the arc-extinguishing chamber 102 is formed by brazing the angular cylindrical body 104 and the flat fixed contact point supporting insulating substrate 105 that seals the upper surface of the angular cylindrical body 104 and fixedly holds the fixed contacts 111 and 112 by means of brazing processing. This allows the fixed contact point supporting insulating substrates 105 to be arranged vertically and horizontally in close contact with each other on the same plane, and the plurality of fixed contact point supporting insulating substrate 105 can be metalized at once, improving the productivity.

After brazing and supporting the fixed contacts 111 and 112 to the fixed contact point supporting insulating substrate 105, the angular cylindrical body 104 can be brazed to the fixed contact point supporting insulating substrate 105, so that the fixed contacts 111 and 112 can be fixedly held easily. Thus, a brazing jig of a simple configuration is enough to perform the brazing processing, and, consequently, the costs of an assembling jig can be reduced.

Moreover, compared to when the arc-extinguishing chamber 102 is formed into the shape of a tub, not only is it possible to manage the flatness of the fixed contact point supporting insulating substrate 105 more easily, but also the fixed contact point supporting insulating substrate 105 can be prevented from being warped. Additionally, a large number of the arc-extinguishing chambers 102 can be manufactured in a lump, reducing the production costs.

In the electromagnetic unit 200, on the other hand, when the exciting coil 208 is excited in an upper open position where the movable plunger 215 contacts the auxiliary yoke 225 and in the open state in which the gap g1 between the peripheral flange part 216 and the upper magnetic yoke 210 is large, a magnetic path that extends from the magnetic yoke 201 with the U-shaped cross section to the movable plunger 215 through the cylindrical auxiliary yoke 203 is formed. This can increase the magnetic flux density of the gap g1 between the lower surface of the peripheral flange part 216 of the movable plunger 215 and the upper surface of the upper magnetic yoke 210, generating larger attractive force. Consequently, the movable plunger 215 can be immediately dropped against the urging force of the return spring 214 and the attractive force of the permanent magnet 220.

Because the lower end surface of the movable plunger 215 approaches the bottom plate part 202 of the magnetic yoke 201 with the U-shaped cross section in the closed state, the relation among the gaps g1 to g4 becomes as follows: g1<g2 and g3>g4. As a result, the magnetic flux generated by the exciting coil 208 directly enters the upper magnetic yoke 210 from the movable plunger 215 through the peripheral flange part 216, passes through the magnetic yoke 201 with the U-shaped cross section from the upper magnetic yoke 210, and directly returns from the bottom plate part 202 to the movable plunger 215, forming the closed magnetic path.

Consequently, large attractive force acts on both the gap g1 and the gap g4, securely keeping the movable plunger 215 dropped.

Furthermore, because the annular permanent magnet 220 that is magnetized in the movable direction of the movable plunger 215 is disposed on the upper magnetic yoke 210 and the auxiliary yoke 225 is formed on the upper surface thereof, attractive force for attracting the peripheral flange part 216 of the movable plunger 215 can be generated with the single annular permanent magnet 220. Therefore, the movable plunger 215 in the open state can be fixed by the magnetic force of the annular permanent magnet 220 and the urging force of the return spring 214, whereby the movable plunger can be retained in the closed state more strongly against shock resulting from a malfunction of the electromagnetic contactor.

The urging force of the return spring 214 can be lowered and a total load obtained from the contact spring 134 and the return spring 214 can be reduced. Consequently, the attractive force generated in the exciting coil 208 can be lowered in response to the reduction in the total load, reducing the magnetomotive force of the exciting coil 208. As a result, the spool 204 in an axial direction can be shortened, and the height of the movable plunger 215 of the electromagnetic unit 200 in the movable direction can be reduced.

Because the height of the movable plunger 215 in the movable direction can be reduced in both the contact point device 100 and the electromagnetic unit 200 as described above, the entire configuration of the electromagnetic contactor 10 can be made much smaller than the conventional example described in Patent Document 1.

Moreover, by disposing the peripheral flange part 216 of the movable plunger 215 on the inner circumferential surface of the annular permanent magnet 220, the closed magnetic path that allows the passage of the magnetic flux generated from the annular permanent magnet 220 can be used efficiently and leakage flux can be reduced, allowing efficient use of the magnetic force of the permanent magnet.

Because the peripheral flange part 216 of the movable plunger 215 is disposed between the upper magnetic yoke 210 and the auxiliary yoke 225 formed on the upper surface of the annular permanent magnet 220, the stroke of the movable plunger 215 can be adjusted by the thickness of the annular permanent magnet 220 and the thickness of the peripheral flange part 216 of the movable plunger 215. Accordingly, the cumulative number of parts or form tolerance that affects the stroke of the movable plunger 215 can be minimized. Fluctuations of the stroke can be minimized as well, because the stroke of the movable plunger 215 is adjusted based only on the thickness of the annular permanent magnet 220 and the thickness of the peripheral flange part 216 of the movable plunger 215.

Figure 10A:
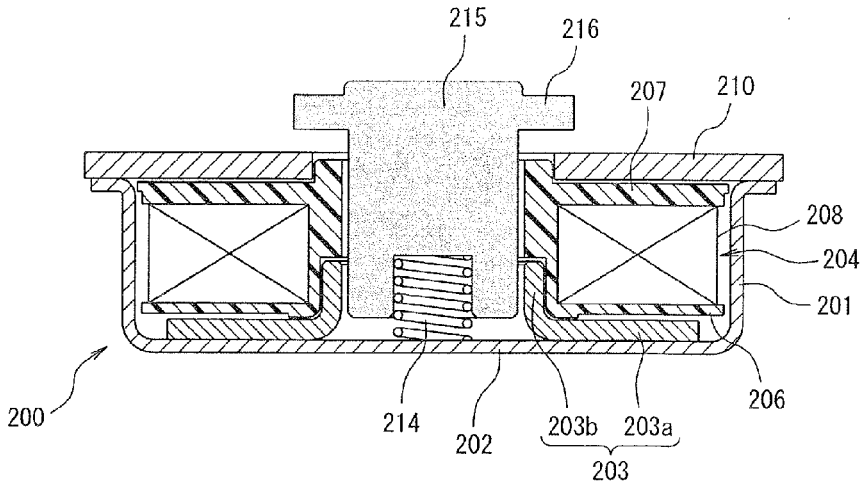
FIGS. 10(*a*)-10(*b*) show diagrams of a modification of a tubular auxiliary yoke of an electromagnetic unit, wherein FIG. 10(*a*) is a cross-sectional diagram and FIG. 10(*b*) is an exploded perspective view.
Figure 10B:
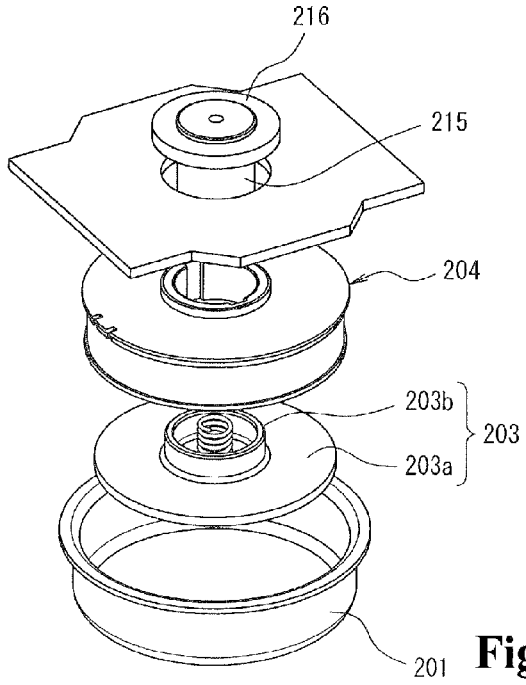

The present embodiment has described the case where the tubular auxiliary yoke 203 is disposed in the vicinity of the lower end of the movable plunger 215, but the present invention is not limited to the embodiment. In other words, the magnetic yoke 201 may be formed with a bottomed tubular body having a U-shaped cross section as shown in FIGS. 10(*a*) and 10(*b*), and then the auxiliary yoke 203 may be configured with a circular plate part 203*a*, the shape of which follows the shape of the bottom plate part 202 of the magnetic yoke 201, and a tubular part 203*b* that stands upward on an inner circumferential surface of the circular plate part 203*a*.

In this case, because the magnetic yoke with a U-shaped cross section is configured with a bottomed tubular body, the space can be used efficiently and the whole circumference of the exciting coil wrapped around the spool can be covered uniformly. Consequently, leakage flux can be reduced. Furthermore, the plate thickness of the yoke can be reduced in order to ensure a magnetic path cross-sectional area required in a side surface of the exciting coil. By attaching the circular plate part 203*a* to the bottom plate part of the bottomed tubular body, a uniform magnetic path can be formed over the entire surface of the bottom plate part.

Figure 11A:
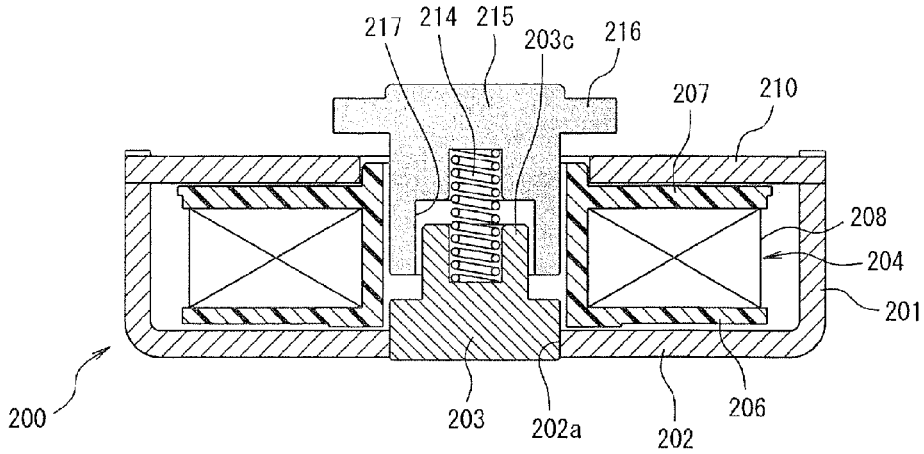
FIGS. 11(*a*)-11(*b*) show diagrams of a modification of the tubular auxiliary yoke of the electromagnetic unit, wherein FIG. 11(*a*) is a cross-sectional diagram and FIG. 11(*b*) is an exploded perspective view.
Figure 11B:
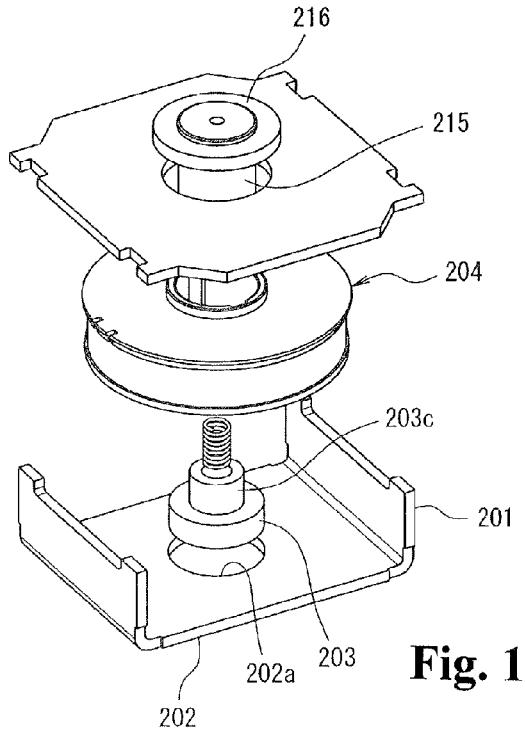

As shown in FIGS. 11(*a*) and 11(*b*), a through-hole 202*a* may be formed on the bottom plate part 202 of the magnetic yoke 201 with a U-shaped cross section, and then a convex-shaped auxiliary yoke 203 may be fitted into the through-hole 202*a*. Subsequently, a small diameter part 203*c* of the auxiliary yoke 203 may be inserted into an insertion hole 217 formed in the movable plunger 215.

In this case, the auxiliary yoke can be attached to the magnetic yoke having a U-shaped cross section by simply fitting the auxiliary yoke into the opening of the magnetic yoke, preventing thermal deformation of the magnetic yoke that is caused by welding or brazing the auxiliary yoke to the magnetic yoke having a U-shaped cross section.

Note that the contact point device 100 is not limited to have the configuration described above, and a contact point device having any configuration is applicable.

Figure 12:
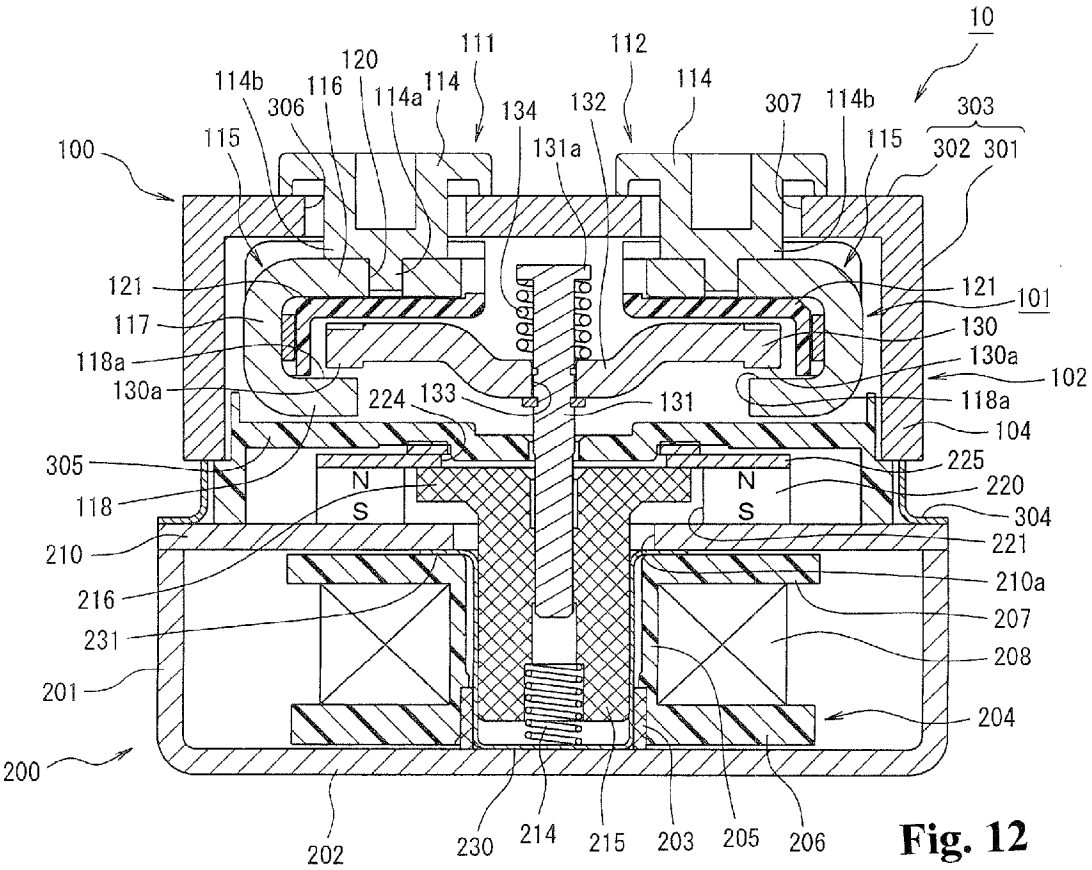
FIG. 12 is a cross-sectional diagram showing a modification of the contact point device of the present invention.

For instance, instead of configuring the arc-extinguishing chamber 102 of the contact point device 100 with the angular cylindrical body 104 and the fixed contact point supporting insulating substrate 105, as shown in FIG. 12 and FIG. 2(*b*), a tub-shaped body 303 may be formed by integrally molding an angular cylindrical part 301 and a top panel part 302 for sealing an upper end of the angular cylindrical part 301, by means of ceramics or synthetic resin material. Subsequently, an open end surface of this tub-shaped body 303 may be metalized to form metal foil, and a metallic connecting member 304 may be joined to this metal foil to form the arc-extinguishing chamber 102.

Figure 13A:
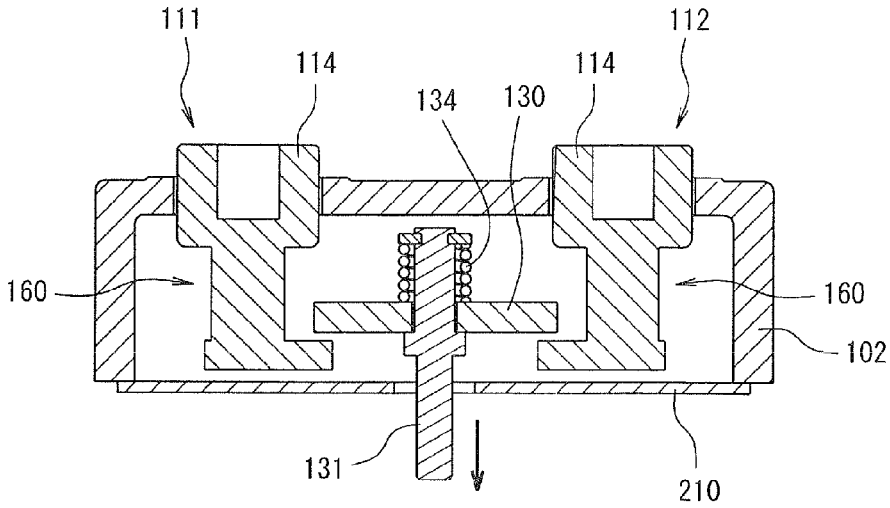
FIGS. 13(*a*)-13(*b*) show diagrams of a modification of a contact point mechanism of the contact point device according to the present invention, wherein FIG. 13(*a*) is a cross-sectional diagram and FIG. 13(*b*) is a perspective view.
Figure 13B:
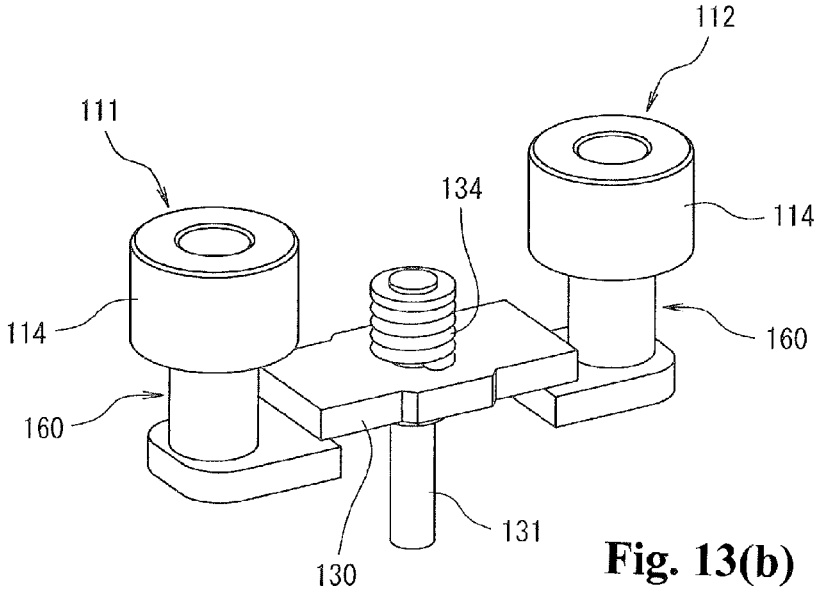

Regarding the fixed contacts 111 and 112, an L-shaped part 160 without the upper plate part 116 of the C-shaped part 115 may be coupled to the support conductor 114, as shown in, for example, FIGS. 13(*a*) and 13(*b*). In this case as well, in the closed pole state where the movable contact 130 contacts the fixed contacts 111 and 112, a magnetic flux generated by the current flowing through a vertical plate part of the L-shaped part 160 can be caused to act on the contact part between the fixed contact 111, 112 and the movable contact 130. As a result, the magnetic flux density of the contact part between the fixed contact 111, 112 and the movable contact 130 can be increased, generating the Lorentz force that acts against the electromagnetic force.

Figure 14A:
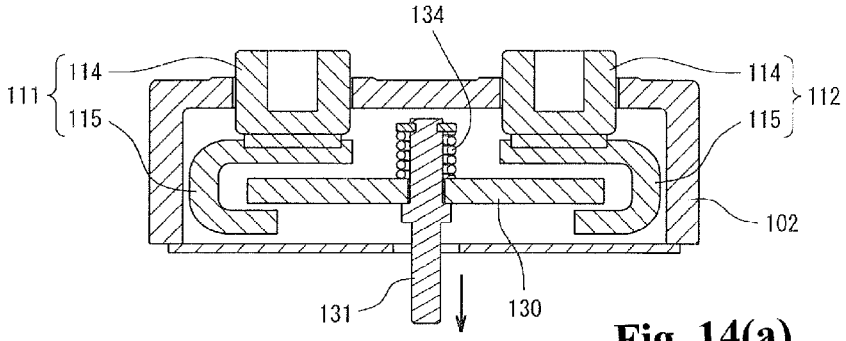
FIGS. 14(*a*)-14(*b*) show diagrams of another modification of the contact point mechanism of the contact point device according to the present invention, wherein FIG. 14(*a*) is a cross-sectional diagram and FIG. 14(*b*) is a perspective view.
Figure 14B:
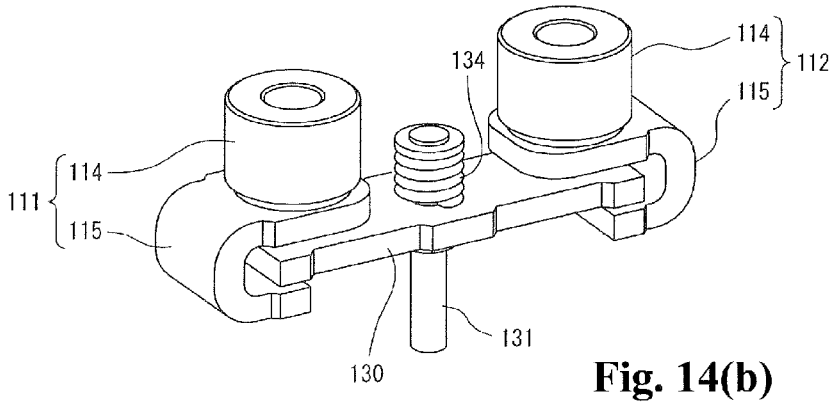

The concave part 132 may be omitted to form the movable contact 130 into a flat shape, as shown in FIGS. 14(*a*) and 14(*b*).

The present embodiment has described the case in which the coupling shaft 131 is screwed to the movable plunger 215; however, any method can be used for connecting the movable plunger 215 and the coupling shaft 131 to each other. The movable plunger 215 and the coupling shaft 131 may also be integrally formed.

The present embodiment has described the case in which the airtight container is configured with the arc-extinguishing chamber 102 and the cap 230; however, when the level of the current to be interrupted is low, the gas may not be encapsulated.

What is claimed is:

1. An electromagnetic contactor, comprising:

a pair of fixed contacts disposed to maintain a predetermined interval;

a movable contact disposed to be capable of contacting with and separating from the pair of fixed contacts; and an electromagnetic unit driving the movable contact;

wherein the electromagnetic unit includes:

a magnetic yoke with a U-shaped cross section, having an open upper part;

an upper magnetic yoke cross-linked in the open upper part of the magnetic yoke with the U-shaped cross section;

a spool disposed on a bottom plate part of the magnetic yoke with the U-shaped cross section, and having an exciting coil wound therearound and a central opening;

a movable plunger movably disposed in the central opening of the spool in an axial direction and having a tip end protruding through an opening formed in the upper magnetic yoke, the movable plunger being urged by a return spring; and a tubular auxiliary yoke forming a magnetic path between the movable plunger and the magnetic yoke with the U-shaped cross section when the movable plunger is in an open position, wherein the movable plunger is coupled to the movable contact through a coupling shaft, the upper magnetic yoke is disposed with an annular permanent magnet to surround a peripheral flange part of the movable plunger, and an upper surface of the annular permanent magnet is disposed with an auxiliary yoke to face an upper part of the peripheral flange part of the movable plunger.

2. An electromagnetic contactor according to claim 1, wherein the magnetic yoke with the U-shaped cross section comprises:

the bottom plate part with rectangle, and side plate parts bent upward to extend from both ends of the bottom plate part in a longitudinal direction.

3. An electromagnetic contactor according to claim 1, wherein the tubular auxiliary yoke comprises a tubular body proximally facing an outer circumferential surface of a lower end part of the movable plunger and fixed to the magnetic yoke with the U-shaped cross section.

4. An electromagnetic contactor according to claim 1, wherein the tubular auxiliary yoke comprises a convex body having:

a large diameter part fitted to an opening formed on the bottom plate part of the magnetic yoke with the U-shaped cross section, and a small diameter part formed on an upper surface of the large diameter part, the small diameter part being inserted into a concave part formed on a lower surface of the movable plunger and to proximally face an inner circumferential surface of the concave part.

5. An electromagnetic contactor, comprising:

a pair of fixed contacts disposed to maintain a predetermined interval;

a movable contact disposed to be capable of contacting with and separating from the pair of fixed contacts; and an electromagnetic unit driving the movable contact, wherein the electromagnetic unit includes:

a magnetic yoke with a U-shaped cross section, having an open upper part;

an upper magnetic yoke cross-linked in the open upper part of the magnetic yoke with the U-shaped cross section;

a spool disposed on a bottom plate part of the magnetic yoke with the U-shaped cross section, and having an exciting coil wound therearound and a central opening;

a movable plunger movably disposed in the central opening of the spool in an axial direction and having a tip end protruding through an opening formed in the upper magnetic yoke, the movable plunger being urged by a return spring; and a tubular auxiliary yoke forming a magnetic path between the movable plunger and the magnetic yoke with the U-shaped cross section when the movable plunger is in an open position, wherein the movable plunger is coupled to the movable contact through a coupling shaft, the magnetic yoke with the U-shaped cross section comprises a bottomed tubular body having an open upper end, the tubular auxiliary yoke comprises:

an annular plate part fixed to a bottom plate part of the bottomed tubular body and having a central opening, and a tubular part formed integrally with an inner circumferential surface of the annular plate part, extending upward, and proximally facing an outer circumferential surface of the lower end part of the movable plunger.

6. An electromagnetic contactor, comprising:

a pair of fixed contacts disposed to maintain a predetermined interval;

a movable contact disposed to be capable of contacting with and separating from the pair of fixed contacts; and an electromagnetic unit driving the movable contact, wherein the electromagnetic unit includes:

a magnetic yoke with a U-shaped cross section, having an open upper part;

an upper magnetic yoke cross-linked in the open upper part of the magnetic yoke with the U-shaped cross section;

a spool disposed on a bottom plate part of the magnetic yoke with the U-shaped cross section, and having an exciting coil wound therearound and a central opening;

a movable plunger movably disposed in the central opening of the spool in an axial direction and having a tip end protruding through an opening formed in the upper magnetic yoke, the movable plunger being urged by a return spring; and a tubular auxiliary yoke forming a magnetic path between the movable plunger and the magnetic yoke with the U-shaped cross section when the movable plunger is in an open position, wherein the movable plunger is coupled to the movable contact through a coupling shaft, $g1<g2$ and $g3<g4$ are established in an open state of the movable plunger, and $g1<g2$ and $g3>g4$ are established in a closed state of the movable plunger, the g1 represents a gap between a peripheral flange part of the movable plunger and the upper magnetic yoke, the g2 is a gap between an outer circumferential surface of the movable plunger and an inner circumferential surface of an opening of the upper magnetic yoke, the g3 is a gap between the movable plunger and the tubular auxiliary yoke, and the g4 is a gap between the bottom surface of the movable plunger and the bottom plate part of the magnetic yoke with the U-shaped cross section.

* * * * *

UNITED STATES PATENT AND TRADEMARK OFFICE

CERTIFICATE OF CORRECTION

PATENT NO. : 8,797,129 B2
APPLICATION NO. : 13/981023
DATED : August 5, 2014
INVENTOR(S) : Yasuhiro Naka et al.

It is certified that error appears in the above-identified patent and that said Letters Patent is hereby corrected as shown below:

In the Specification

Please change column 10, line 6, from "... path is foiled in..." to -- path is formed in --.

In the Claims

Please change column 17, line 28, from "... the movable contact..." to -- movable contact --.

Signed and Sealed this
Seventeenth Day of February, 2015

Michelle K. Lee

Michelle K. Lee
*Deputy Director of the United States Patent and Trademark Office*